United States Patent [19]

Rosner et al.

[11] 3,961,108

[45] June 1, 1976

[54] METHOD FOR TREATING SURFACES OF WOOD PANELS

[76] Inventors: Wolfgang Rosner, Hosefsburgstrasse 73a, 8000 Munich 80; Georg Dröse, Hauptstrasse 29, 8136 Percha, both of Germany

[22] Filed: Mar. 11, 1974

[21] Appl. No.: 449,653

[30] Foreign Application Priority Data

Dec. 13, 1973 Germany ..... 2362028

[52] U.S. Cl. ..... 427/275; 427/276; 427/277; 427/325; 427/368

[51] Int. Cl.[2] ..... B05D 3/00; B05D 3/12

[58] Field of Search ..... 117/8, 11, 57, 58; 427/275, 276, 277, 325, 274, 368

[56] References Cited

UNITED STATES PATENTS

| | | | |
|---|---|---|---|
| 3,081,159 | 3/1963 | Brown | 117/57 X |
| 3,450,554 | 6/1969 | Watson | 117/57 |
| 3,542,641 | 11/1970 | Showalter et al. | 117/8 X |
| 3,816,155 | 6/1974 | Iverson et al. | 117/8 X |

*Primary Examiner*—Michael R. Lusignan
*Attorney, Agent, or Firm*—Baldwin, Egan, Walling & Fetzer

[57] ABSTRACT

A method, and a machine for performing the method, for treating wood panels to develop a relief therein, and including subsequent staining, comprising brushing a panel to develop a relief, and then flooding the panel with liquid stain, and after drying, again brushing the panel surface, resulting in a contrasting and attractive panel surface.

9 Claims, 4 Drawing Figures

1
2
3
4
5a
5
5b
6
7
8
9
10
11
12
13
14
P
II 1
2
3
4
5a
5
5b
6
7
8
9
10
11
12
14

METHOD FOR TREATING SURFACES OF WOOD PANELS

It has been known to treat the surfaces of wood panels with rotating metallic brushes so as to develop a relief and further to stain such surfaces in a contrasting manner so that the hard wood portions, i.e., the annual rings, appear in outstanding relief and are more darkly stained than the softer wood portions therebetween.

It is an object of the invention to subject wood panels to a treatment that will result in a uniform, contrasting, and attractive panel surface.

According to the invention this object is attained with a method for treating surfaces of wood panels, in which the panel surface is treated with brushes to develop a relief and is subsequently stained, the method comprising flooding the panel surface, after brushing, with liquid stain and, after drying, brushing wax into the panel surface, said wax having been applied in finely dispersed form.

According to a preferred embodiment of the invention the wood panel, prior to staining, is passed first beneath cylindrical brushes rotating about horizontal axes oriented perpendicular to the longitudinal extension of the panel, and is then passed beneath a plurality of cylindrical brushes rotating about horizontal axes which extend in longitudinal direction of the panel and are offset parallel to one another, and is then passed beneath cup brushes rotating about vertical axes.

In a machine for treating surfaces of wood panels so as to develop a relief, according to the invention there are provided in succession above a panel conveying belt, cylindrical steel brushes rotating about horizontal axes extending transversely to the longitudinal extension of the panel, a plurality of cylindrical steel brushes rotating about horizontal axes extending parallel to the longitudinal extension of the panel, the axes of rotation of these brushes being offset symmetrically to the center of the panel, a cylindrical polishing brush rotating about a horizontal axis extending transversely to the longitudinal extension of the panel, and a stain flooding device positioned at the outlet end of said conveyor belt.

Figure 1:
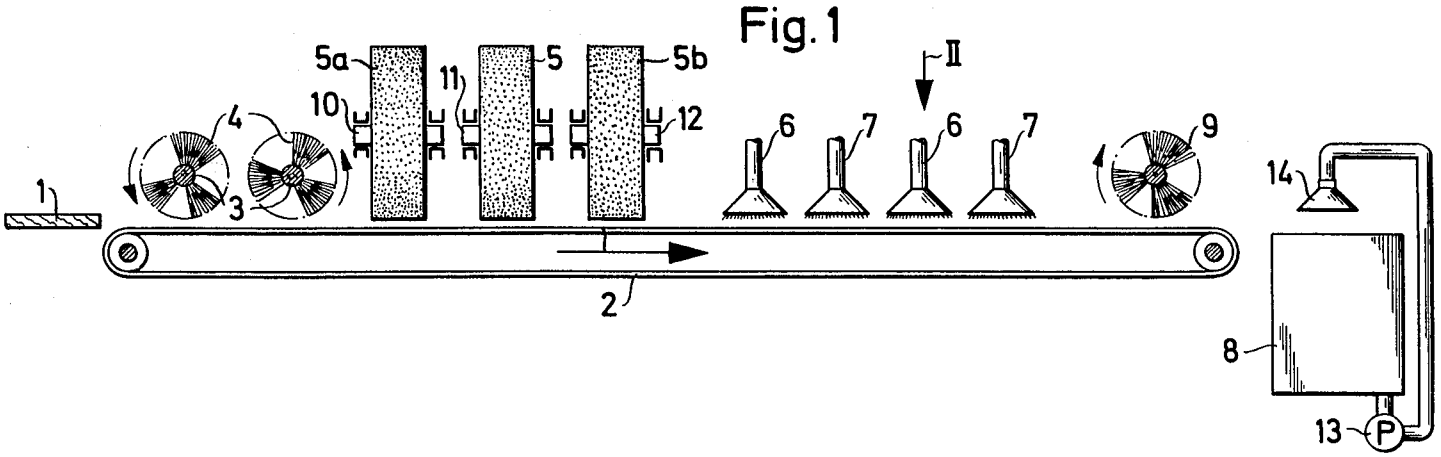
Figure 2:
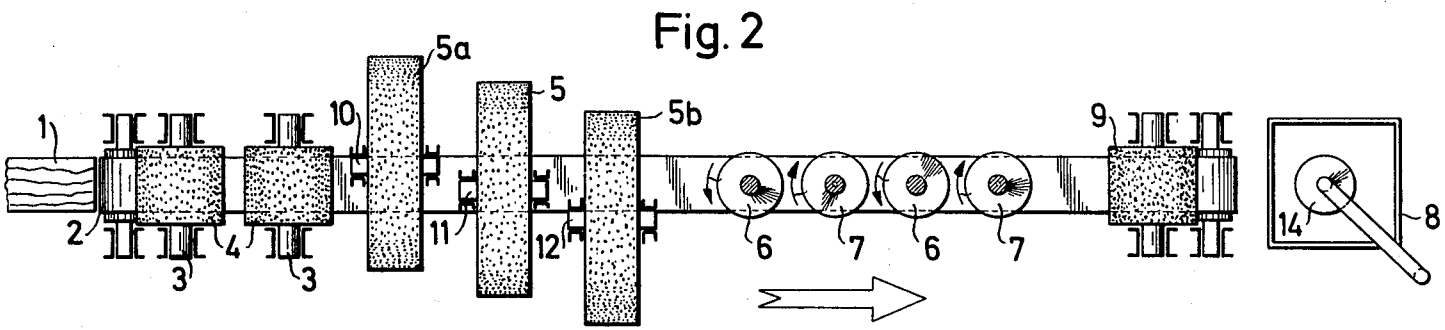
Figure 3:
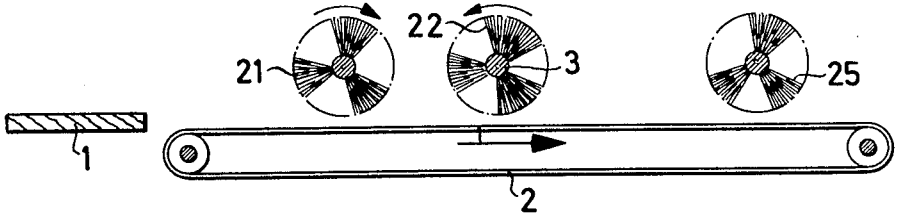
Figure 4:
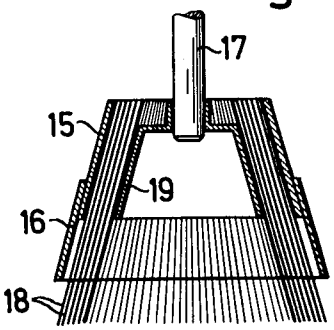

Further objects and advantages of the invention will become apparent from the following description in conjunction with the accompanying drawings, in which FIGS. 1 and 2 are a schematic side elevation and a plan view, respectively, of a machine for treating wood panel surfaces;

FIG. 3 is a schematic side elevation showing the post-treatment of a wood panel that has been surface-treated, waxed, stained, and dried; and FIG. 4 is a schematic view of a cup brush used in the invention.

The reference characters used in the drawings denote the following parts.

The planed and well-dried wood panel 1 is a continuously moved on a conveyor belt 2 or the like in a direction indicated by the arrow. The axes of rotation of two cylindrical steel brushes 4 extend horizontally and are oriented transversely to the longitudinal extension of the panel. The direction of rotation of said cylindrical steel brushes 4 is selected such that the cylinder surfaces facing the wood panel move in the same direction as the panel 1 to be treated.

The horizontal axes 10, 11, 12 of rotation of cylindrical steel brushes **5, 5*a* and 5*b* extend parallel to the longitudinal axis of the wood panel. The cylindrical brushes are symmetrically offset with respect to the center line of the panel. The diameter of the cylindrical brushes 5, 5*a* and 5*b* is selected to be greater than the width of the panel 1** and preferably amounts to 1.5 to 2 times the width of the panel.

The sense of rotation of the cylindrical brushes **5*a* and 5*b*, which are arranged asymmetrical to the center of the panel, is selected so that those brush portions below the axes 10 and 12** of rotation whose abrasive effect on the panel is strongest move along the edge of the panel towards the center thereof.

Two pairs of steel cup brushes 6, 7 rotate about vertical axes. The cup brushes are arranged symmetrical with respect to the center of the panel, and pairs of brushes rotate in opposite directions.

A cylindrical polishing or buffing brush 9 has a horizontal axis of rotation oriented transversely to the longitudinal extension of the panel.

The cylindrical brush 4 at the intake end of the conveyor belt rotates at about 800 r.p.m., and the second cylindrical brush rotates at about 1400 r.p.m. The diameter of the wires of the first cylindrical brush is about 0.3 mm, and that of the wires of the second cylindrical brush is about 0.2 mm. Both brushes have the same sense of rotation, viz., in moving direction of the panel 1 as indicated in the drawing. The speed of the conveyor belt is about 9 to 12 meters per minute.

The steel wires of the first two of the cup brushes 6, 7 rotating about vertical axes have a diameter of, for instance, 0.3 mm and those of the further brushes a diameter of, for instance, 0.2 mm. The cup diameter of these brushes, which are oriented approximately towards te center of the panel 1, amounts to about 1.5 times the panel width so that substantially only those portions of the cup brushes which extend transversely to the moving direction of the panel will act on the panel and will promote the development of relief during lateral engagement at the panel. The speed of rotation of the cup brushes is about 1200 r.p.m.

The cylindrical polishing or buffing brush 9 is a plastics corundum polishing brush rotating at about 600 r.p.m. about a horizontal axis in opposition to the moving direction of the panel.

The wood panel let off from the conveyor belt 2 is passed beneath a shower 12 flooding the panel with liquid stain contained in a tank. Having regard to the further processing of the panel, the liquid stain preferably contains wax in finely dispersed form. 13 is a feed pump, and the supply pipe to the shower 14 is arranged so as not to interfere with further movement of the wood panel 1.

Having thus been treated to bring out a relief, and having further been stained on its upper surface, the panel will now be dried.

Subsequent to drying, the panel 1 is passed through the second machine unit shown in FIG. 3. This unit also has a conveyor belt 2. Two cylindrical fiber brushes 21 and 22 rotate in opposite direction about horizontal axes oriented perpendicular to the moving direction of the panel. These brushes smooth or polish the waxed and stained panel surface, wherein it has to be observed that at the harder wood portions the staining appears darker than at the softer, reliefed wood portions. The panel 1 is then passed beneath a fiber drum 25 rotating in opposite sense about a horizontal axis; this fiber drum effects further polishing or smoothing of the waxed panel surface.

The brush devices of the machine unit of FIG. 3 are very soft so that they may have a smoothing or polishing effect both on the outstanding reliefed hard wood portions and on the removed, negatively reliefed soft wood portions.

The cup brush of FIG. 4 comprises bristles 18 clamped between cup-shaped clamping members 19, 15. 16 is an extension of the cup surface of the cups 15, and 17 is the rotating shaft of the cup brush.

The product made according to the method of the invention comprises a surface having a contrastingly stained grain, in which the more darkly stained, hard wood portions are left in outstanding relief in contrast to the less stained, soft wood portions, and in which further the thus contrastingly stained wood surface is uniformly smoothed or polished and waxed.

What is claimed is:

1. A method for treating a surface of a wood panel in which the panel surface is treated with brushes to develop a relief and subsequently is stained comprising: brushing the panel surface by means of first brush means rotating about a generally horizontal axis extending substantially transverse to the longitudinal extension of the panel to develop a relief in the longitudinal direction of the panel surface, then brushing the panel surface by second brush means rotating about an axis extending in a direction generally perpendicular to the direction of extension of the first mentioned axis, to apply relief producing brushing generally transverse of said longitudinal extension of the panel, then flooding the panel surface with liquid stain and brushing wax into the panel surface whereby said panel surface is smoothed.

2. The method according to claim 1, wherein prior to said staining, the wood panel is passed first beneath cylindrical brushes comprising said first brush means rotating about horizontal axes oriented generally perpendicular to the longitudinal extension of the panel, and is then passed beneath a plurality of cylindrical brushes comprising said second brush means rotating about horizontal axes which extend in the longitudinal direction of the panel and are offset parallel to one another, and is then passed beneath cup brushes rotating about vertical axes, said cup brushes likewise comprising said second brush means for applying further brushing generally transverse of said longitudinal extension of the panel, and wherein said brushing of said wax into the panel surface occurs in said longitudinal direction of the panel surface.

3. A method according to claim 1 including applying said wax to said surface simultaneously with said stain, and wherein said stain contains said wax in finely dispersed form.

4. A method in accordance with claim 1 wherein said panel is adapted to be moved face up beneath said brush means, including rotating said first brush means about horizontal axes extending generally transverse of the path of movement of the panel, and then rotating said second brush means about vertical axes extending generally transverse of said path.

5. A method in accordance with claim 4 wherein said second brush means includes a plurality of cylindrical brushes rotatable about horizontal axes which extend parallel in the longitudinal direction of the panel surface and including offsetting the axes of rotation of the last mentioned brushes with respect to the lengthwise center of the path of movement of the panel.

6. A method for treating surfaces of wood panels, in which the panel surface is treated with brushes to develop a relief and subsequently is stained, comprising steps of first passing the wood panel beneath metal wire cylindrical brushes rotating about horizontal axes extending generally transversely to the longitudinal extension of the panel to develop a relief in the longitudinal direction of the panel surface, and next beneath a plurality of metal cylindrical brushes rotating about horizontal axes extending in the same general direction and generally parallel to the longitudinal extension of the panel, the last mentioned axes being offset symmetrically to the vertical longitudinal center plane of the panel and extending in a direction generally perpendicular to the direction of extension of the first mentioned axes of apply relief producing brushing generally transverse to said longitudinal extension of the panel, and then passing the panel through a stain flooding device for staining the panel surface ad applying wax in finely dispersed form to the panel surface and then passing said panel surface underneath polishing brush means rotatable about generally horizontal axes extending generally transverse to the longitudinal extension of the panel, whereby said panel surface is smoothed.

7. A method in accordance with claim 6, in which the wood panel, after having been passed underneath the first and second mentioned cylindrical brushes, is passed underneath steel cup brushes rotatable about generally vertical axes extending transverse to the wood panel plane, with the last mentioned vertical axes extending generally perpendicular to the direction of extension of the first mentioned axes for applying a further relief producing brushing generally transverse of said longitudinal extension of the panel and prior to the staining and waxing of the panel surface.

8. A method according to claim 5, in which the sense of rotation of the cylindrical brushes, which are offset to the center line of the panel, is selected such that the brush surfaces beneath the axes of rotation move over the panel from the edge of the panel towards the center thereof.

9. A method according to claim 1 characterized in that after having passed the panel surface beneath said first brush means, the panel surface is passed beneath steel cup brushes rotatable about generally vertical axes extending transverse to the wood panel plane, each said cup brush having a diameter of approximately 1.5 times the panel width and comprising said second brush means.

* * * * *